United States Patent [19]

Ishikawa et al.

[11] Patent Number: 4,998,884

[45] Date of Patent: Mar. 12, 1991

[54] CONNECTOR APPARATUS FOR HIGH DENSITY COAXIAL CABLES

[75] Inventors: Kouji Ishikawa; Kyoichiro Kawano; Teruo Murase, all of Yokohama, Japan; Jerzy R. Sochor, Santa Cruz; C. Timothy Norman, San Jose, both of Calif.

[73] Assignees: Fujitsu Limited, Kawasaki, Japan; Amdahl Corporation, Sunnyvale, Calif.

[21] Appl. No.: 301,707

[22] Filed: Jan. 26, 1989

[30] Foreign Application Priority Data

Jan. 26, 1988 [JP] Japan ..... 63-008695
Jan. 26, 1988 [JP] Japan ..... 63-008696
Jan. 26, 1988 [JP] Japan ..... 63-008697

[51] Int. Cl.[5] ..... H01R 13/652
[52] U.S. Cl. ..... 439/49; 439/94; 439/358; 439/372
[58] Field of Search ..... 439/110, 121, 353, 357, 439/358, 49, 372, 680, 94, 104

[56] References Cited

U.S. PATENT DOCUMENTS 3,829,821 8/1974 Derr et al. ..... 439/353 X
4,764,129 8/1988 Jones et al. ..... 439/680 X

FOREIGN PATENT DOCUMENTS 60-10284 4/1985 Japan .
60-91578 5/1985 Japan .
60-35971 10/1985 Japan .
60-32265 2/1986 Japan .
61-194275 12/1986 Japan .
2071928 9/1981 United Kingdom ..... 439/358

*Primary Examiner*—Z. R. Bilinsky
*Attorney, Agent, or Firm*—Staas & Halsey

[57] ABSTRACT

An apparatus for connecting a high density cable assembly having a shield and to be connected to corresponding contact pins provided on a substrate having a grounding grid formed of conductive guides, each having a predetermined number of contact pins therein, including a connector to which the cable assembly is connected and which is to be mounted to the associated guide. The connector has a connector body, a connector cover surrounding the connector body, and a latching device provided between the connector cover and the connector body for easily latching and unlatching the connector to and from the associated guides.

12 Claims, 13 Drawing Sheets

CONNECTOR APPARATUS FOR HIGH DENSITY COAXIAL CABLES

BACKGROUND OF THE INVENTION

1. Field of the Invention

The present invention relates to a connector for a high density cable, more particularly, it relates to a mechanism for connecting a coaxial cable to a printed circuit board through an associated latch, the connectors being located on the printed circuit board in a matrix arrangement and at a high density.

Due to a current requirement for an increased density of connectors mounted on a printed circuit board (referred to as a PC board hereinafter), a matrix mounting system in which a desired number of contact pins is grouped into a block, and a plurality of connectors are located in a matrix arrangement corresponding to the desired number of contact pins, is used. In this matrix mounting system, however, because the number of connectors is increased the latch means must be improved to prevent interference between connectors located very close to each other, in order to increase the mounting density thereof, in a very small mounting space.

2. Description of the Related Art

In known connector latch means, the connectors are individually secured to the PC board by set screws, or connectors in the same row of a matrix are latched together. The coaxial cables to be connected to the respective connectors are provided with grounding shields, and the shield connection is made by mating special grounding contacts and the contact pins by plugging them together.

The conventional latching means and related assembly method mentioned above has drawbacks in that it is very difficult to mount and dismount the connectors and that the latching means is large and complex therefore and therefore, preferably a simple latching means is provided for each connector, by which an effective utilization can be made of a very small mounting space. Note, the plug-in shield connection of the cable allows an increased number of contact pins and an increased number of patterns of the PC board to be used. Preferably, the shield of the cables is directly connected to a frame of a housing of the associated apparatus, to ground same. In this case, preferably the connectors themselves are grounded to prevent a generation of static electricity when an operator accidentally touches the connectors during the mounting and dismounting thereof.

SUMMARY OF THE INVENTION

The primary object of the present invention is to provide connectors for high density coaxial cables by which the shield connection of the cables is optimized by providing a one-touch type latch means for each connector.

To achieve the above object, according to the present invention, there is provided an apparatus for connecting high density cables having a shield and to be connected to corresponding contact pins provided on a substrate having a grounding grid of conductive guides, each having a predetermined number of contact pins, comprising a connector, to which the cables are connected, having a connector body and a connector cover surrounding the connector body, the connector comprising a clamping means provided on the connector cover for clamping the shields of the cables, and a latching means arranged between the connector cover and the connector body for latching the connector to the associated guides in such a way that they are easily unlatched.

With this arrangement, a plurality of connectors each having the latching means can be easily and quickly latched and unlatched to and from the associated guides. The shields of the cables are grounded through the guides.

Preferably, the latching means comprises a rotatable latching lever for latching and unlatching the connector to and from the associated guides by a one-touch operation.

Also, preferably, the latching lever is provided with hooks, and the guides are provided with corresponding abutments with which the associated hooks can engage. The latching lever is rotatably supported by and on the connector cover in such a manner that a rotation of the latching lever causes the cover to be latched and unlatched to and from the associated guides.

BRIEF DESCRIPTION OF THE DRAWINGS

The invention will be described below in detail with reference to the accompanying drawings, in which.

DESCRIPTION OF THE PREFERRED EMBODIMENTS

Figure 1:
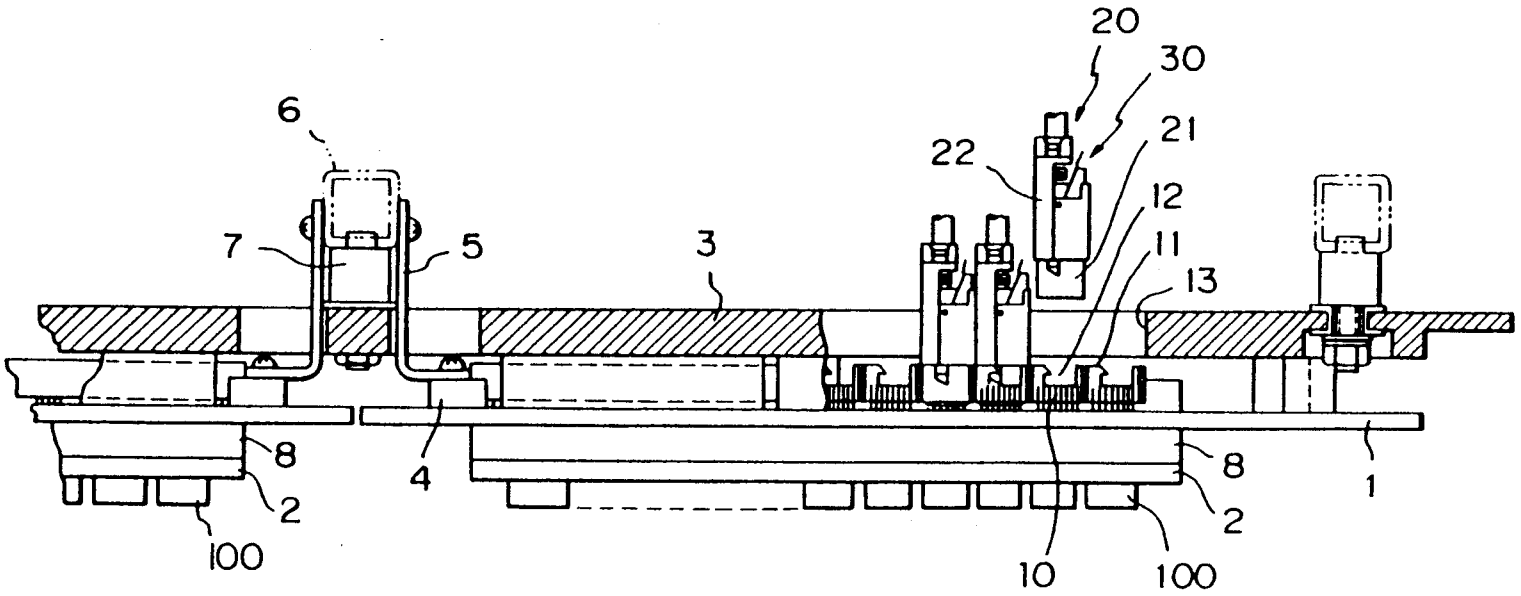
FIG. 1 is a partially sectioned side elevational view of a connector apparatus according to an aspect of the present invention.
Figure 2:
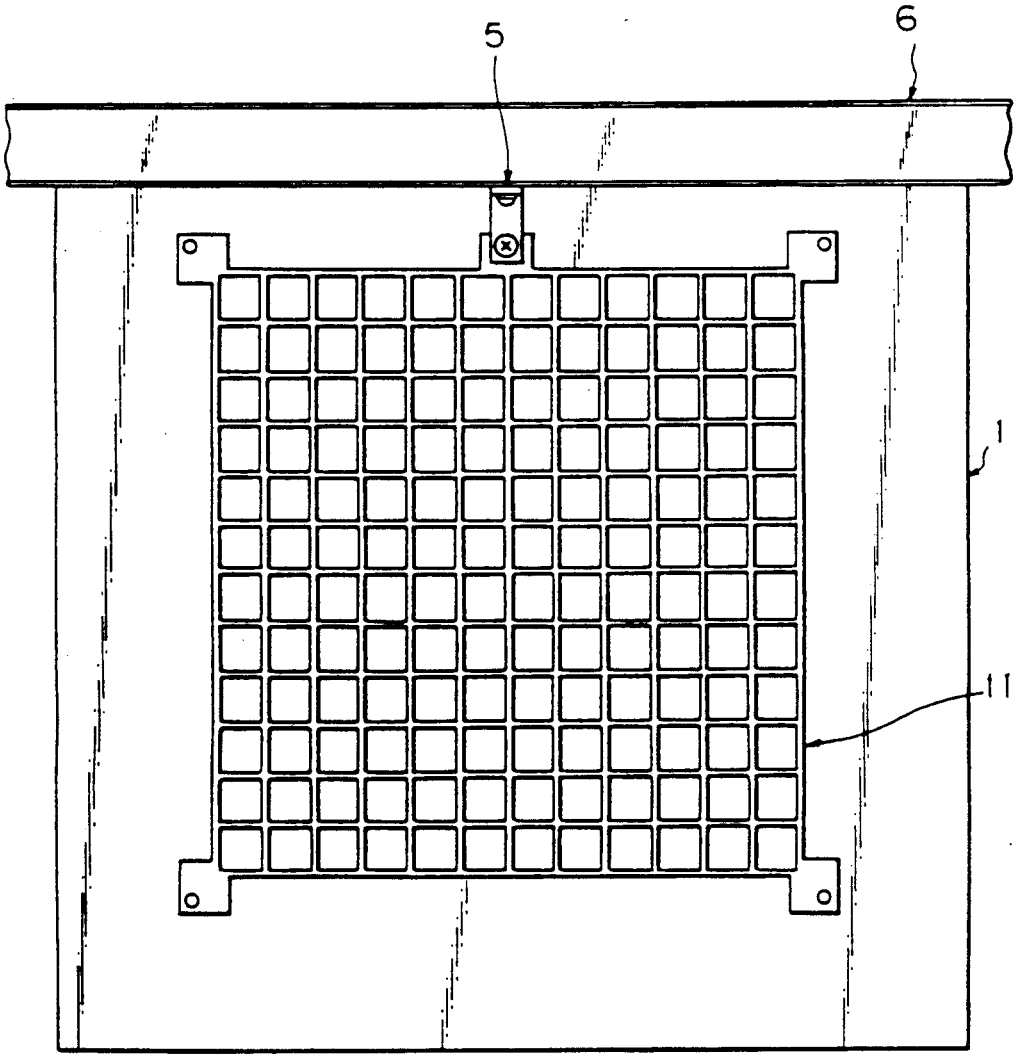
FIG. 2 is a plan view of a mother board having guides in a matrix arrangement shown in FIG. 1.
Figure 3:
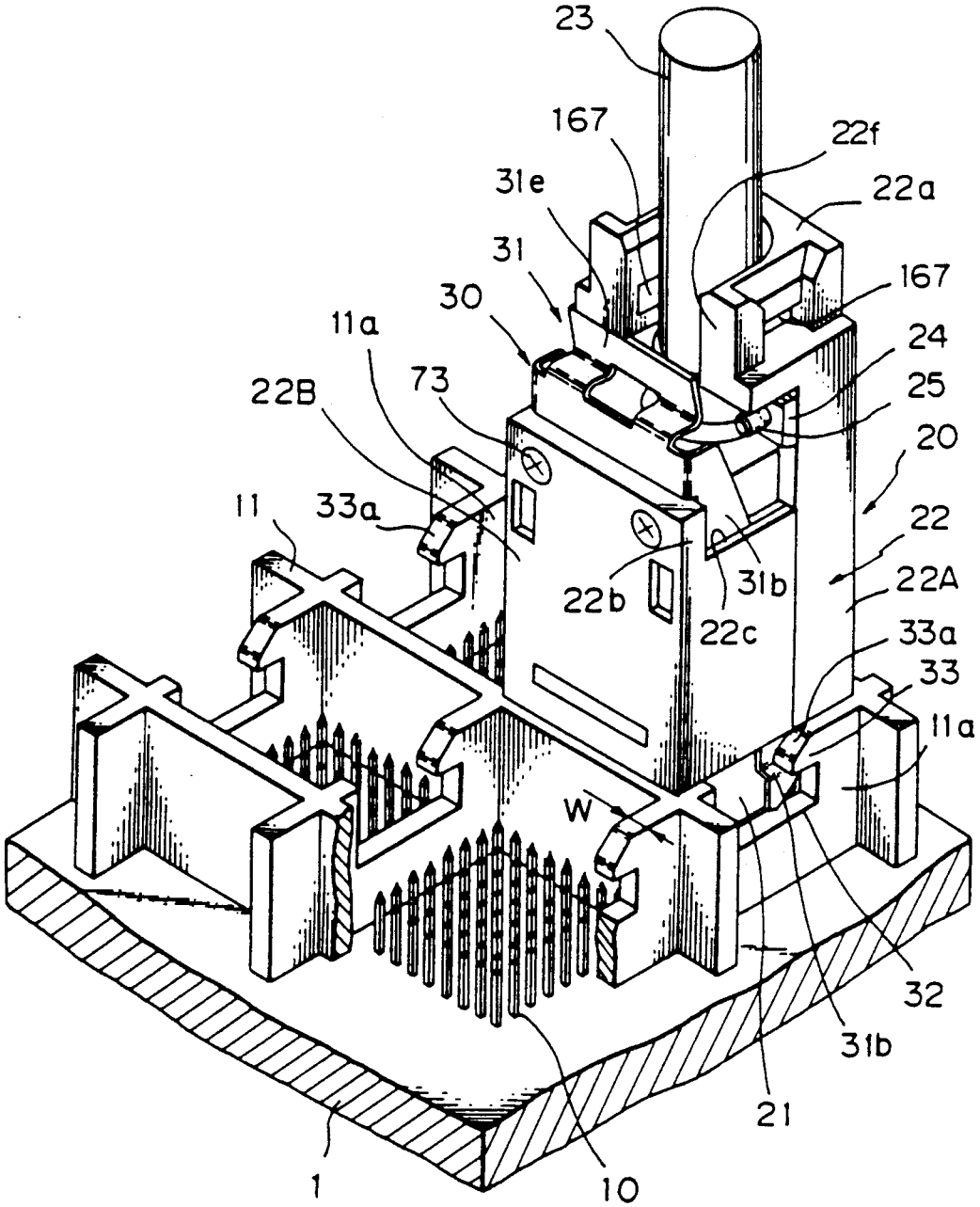
FIG. 3 is a partially broken perspective view of a connector apparatus shown in FIG. 1.

Referring to FIGS. 1, 2 and 3, a printed circuit board (PC board) 2 has LSI's 100 mounted thereon on one surface (lower surface in the illustrated embodiment) of a mother board (substrate) 1 by connectors 8, and on the surface of the mother board 1 opposite to the PC board 2 (which can be a substrate in the absence of the mother board) a grounded frame 3 is provided in parallel with the plane of the mother board. The mother board 1 is attached to a housing frame 6 by mounting frames 4 and L-shaped mountings 5. The grounded frame 3 is connected to the frame 6 by a connecting means 7, to form an electrical shielding circuit.

A number of contact pins 10 corresponding to the LSI's 100 are provided on the side of the mother board 1 close to the grounded frame 3. The contact pins 10 are divided into groups of a predetermined number of the contact pins 10, in a grid-like arrangement, by guides 11. The guides 11 are made by metal die casting and are taller than the contact pins 10. The guides 11 are held by the mounting frame 4 in such a manner that a clearance exists between the guides 11 and the mother board 1; and so that the guides 11 per se are grounded. Connecting portions 12, defined by the guides 11 to form a matrix, are connected by a plurality of connectors 20 which extend through corresponding openings 13 of the grounded frame 3.

Figure 4A:
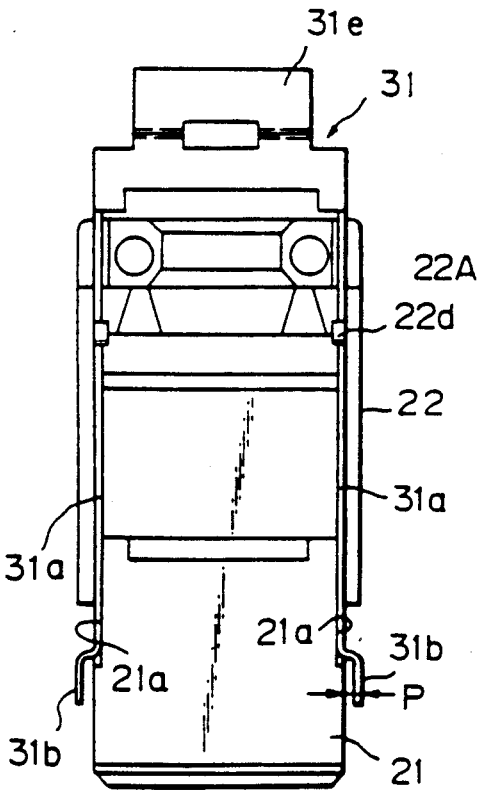
FIGS. 4A and 4B are a front elevational view and a partially sectioned side elevational view of a connector cover shown in FIG. 1 respectively.
Figure 4B:
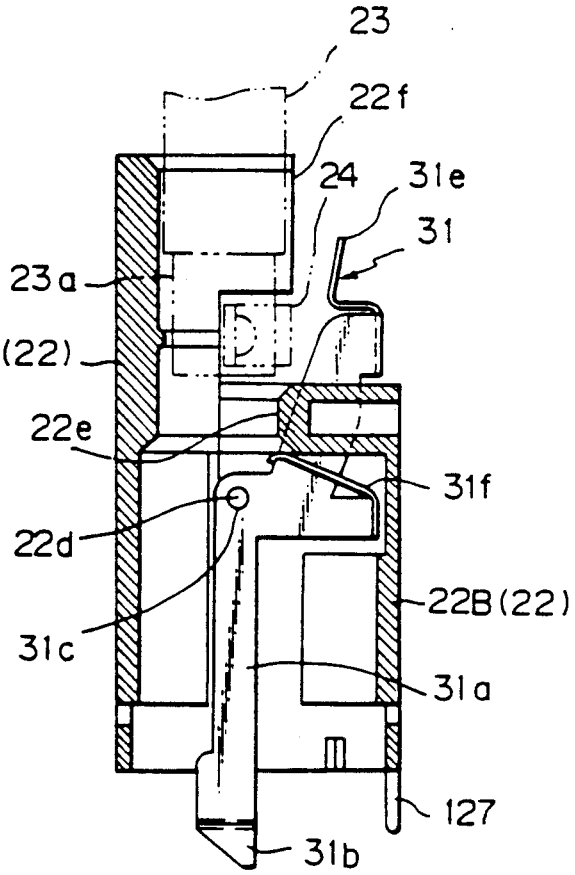

As the connectors 20 are identical, the following description is directed to only one of the connectors 20, with reference to FIGS. 3 and 4A and 4B. The connector 20 has a generally rectangular box-like connector body 21 containing contacts to be connected to associated contact pins 10 in a plug-in manner. The connector body 21 can be loosely inserted in the associated guide 11 before the final connection with the contact pins 10. The connector body 21 is provided with a rectangular box-like metal cover 22, which preferably consists of two parts 22A and 22B secured to each other by set screws 73, surrounding the periphery of an upper part of the connector 20. Namely, the lower part of the connector body 21 is not covered by the cover 22, as can be seen from FIG. 4A. The height of the uncovered area of the connector body 21 depends on the height of the guides 11. The front cover part 22A is provided at the upper end thereof with a cable mounting portion **22*a* integral therewith, so that a shield 23*a* of an associated coaxial cable assembly 23 having a plurality of coaxial cables is held by a clamp 24 secured to the cable mounting portion 22*a* by screws 25 and connected to the cover 22. The cover 22 is provided at the upper end thereof with an opening 22*c* located below the cable mounting portion 22*a* and having a stepped stop 22*b*. A latching means 30, described hereinafter, is provided in the opening 22*c***.

Figure 5:
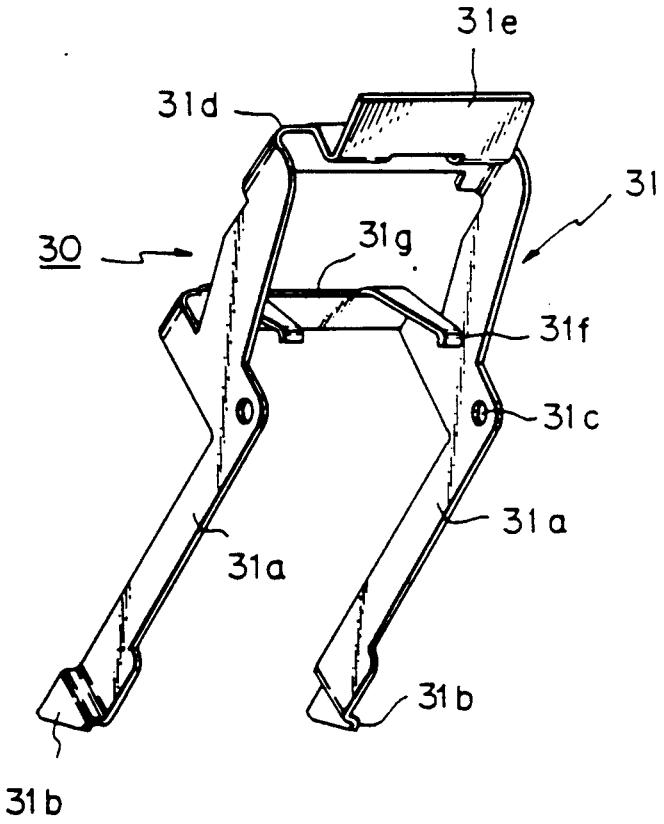
FIG. 5 is a perspective view of a latching lever according to an aspect of the present invention.

The latching means 30 includes a generally inverted U-shaped (gate-like) latch lever 31 made of metal, as best shown in FIG. 5. The latch lever 31 has right and left legs **31*a* having tapered hooks 31*b*, which are bent outward, at the lower ends thereof. The legs 31*a* are also provided with pin holes 31*c* at an intermediate portion thereof. The upper ends of the legs 31*a* are interconnected to form an abutment surface 31*d* having a bent grip 31*e*. The latch lever 31 is also provided with a bridging portion 31*g* connecting the leg portions 31*a* and having spring arms 31*f*. The latch lever 31 is located in the cover 22 in such a way that the grip 31*e* is protruded outside thereof through the opening 22*c*, the abutment surface 31*d* bears against the stop 22*b*, the legs 31*a* extend downward in side recesses 21*a* formed on opposite right and left side faces of the connector body 21, and the hooks 31*b* are located outside the cover 22. The latch lever 31 is rotatably supported on the cover 22 by associated pins (shafts or projections) 22*d* provided on the inner side faces of the cover 22 and rotatably fitting in the associated pin holes 31*c*, to enable the legs 31*a* to rotate about the respective pins 22*d*. The free ends of the spring arms 31*f* bear against an inner projection 22*e* provided on the cover 22 (rear cover part 22B) to elastically bias the latch lever 31 in a counterclockwise direction (in FIG. 4B), whereby the legs 31 are held in a vertically extended position by the stop 22*b***.

Furthermore, as shown in FIG. 3, each guide 11 is provided with abutments 33 defining recesses 32 and having tapered upper edges **33*a* on the right and left side walls 11*a* of the guide 11. Note that, in the illustrated embodiment, since one abutment 33 is common to the two adjacent hooks 31*b* of the two adjacent latch levers 30, the amount P (FIG. 4A) of outward projection of the hooks 31*b* is substantially equal to or less than half the width w (FIG. 3) of the abutment 33**.

Figure 6:
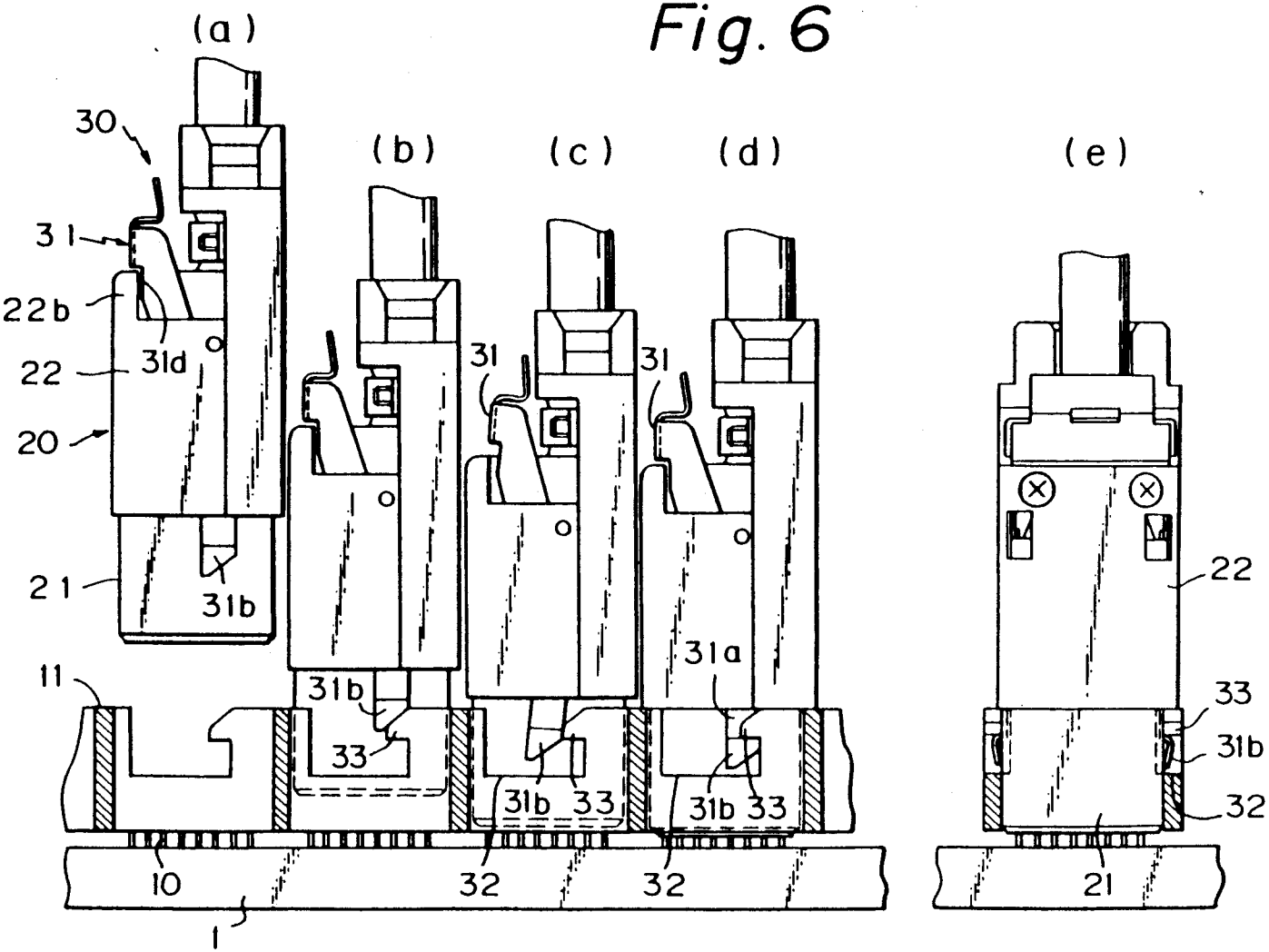
FIG. 6 is a view showing consecutive steps of connecting a connector to a substrate, according to the present invention.

FIG. 6 shows the consecutive steps (a) to (d) for connecting the connector 20 to the guide 11 by the associated latch means 30. In FIG. 6, before the connection, the latch lever 31 of the latching means 30 bears against the stop **22*b*, so that the leg 31*a* and the hooks 31*b* are vertically extended. From this position, when the connector 20 is inserted into the associated guide 11 the plug-in connection begins, and the hooks 31*b* of the latch lever 31 come into contact with the tapered edges of the associated right and left abutments 33 of the guide 11, as shown in FIG. 6** (*b*). A further insertion of the connector 20 causes the hooks **31*b* of the latch lever 31 to slide down on the tapered edges of the abutments 33, thus resulting in an elastic deformation of the latch lever 31, as shown in FIG. 6** (*c*). Namely, the latch lever 31 rotates about the pins **22*d* in a clockwise direction in FIG. 4B. Note that the rotation, i.e. the elastic deformation of the legs 31*a* of the latch lever 31, occurs in a plane substantially parallel with the opposite side faces of the connector body 21. The hooks 31*b* lie in a plane parallel with the plane of the legs 31*a*, as can be seen from FIG. 4A, and accordingly, the displacement (deformation) of the hooks 31*b* also occurs in a plane substantially parallel with the side faces of the connector body 21**.

When the plug-in connection is completed, i.e. when the hooks **31*b* pass the associated abutments 33, the latch lever 31 is elastically returned to the initial position thereof shown in FIG. 6** (*a*), due to the elastic bias applied thereto, as shown in FIG. 6 (*d*), so that the hooks **31*b* are snap-engaged by the associated abutments 33 to lock the latch lever 31 in position, and accordingly the connector 20, in the guide 11. In the locked or latched position shown in FIG. 6** (*d*), the lower end of the cover 22 comes into contact with the upper peripheral surface of the guide 11.

Note, when the connector 20 is in the latched position, the shield **23*a* of the cable assembly 23 is connected to the grounded frame 3 through the cover 22, the latch lever 31, and the guide 11, and therefore, the shield 23*a* of the cable, the cover 22, etc., of the connector 20, and the guide 11** are directly grounded and electrically shielded.

FIG. 6 (*e*) shows the latched (or locked) position shown in FIG. 6 (*d*), as viewed from the left side of FIG. 6 (*d*).

When the connector 20 is to be disconnected from the associated guide 11, the latch lever 31 is rotated in the counterclockwise direction in FIG. 4B by manual pressure exerted on the grip **31*e* by the operator's finger, to disengage the hooks 31***b* from the associated abutments 33. The connector 20 can be then easily pulled up, to separate the connector body 21 from the contact pins 10. Note that, when pressure is applied to the grip 31*e*, the grip 31*e* is brought into contact with an end surface (stop surface) 22*f* of the cable mounting portion 22*a* of the cover 22 to hold the latch lever 31 at an elastically deformed position and thus enable the disconnection of the connector 20 from the contact pins 10.

As can be understood from the above description, according to the present invention, since each connector is provided with a latching means able to be operated by a one-touch operation, the connectors can be easily and firmly connected to the P.C. board.

Further, since the latching means 30 which ensure this connection in cooperation with the associated guides 11 provided on the mother board 1 are accommodated between the connector bodies 21 and the connector covers 22, the connector mechanism can be made compact and small.

Also, since the elastic latching means are in the form of a gate having right and left legs 31*a* by which the opposite sides of the associated connectors are latched, a strong latching effect is obtained.

Note, the latching means also contributes to a prevention of connection failures among a plurality of the connectors and the contact pins, since the latching levers 31 are engaged in corresponding recesses 21*a*, FIG. 4A formed on opposite sides of the connector body 21.

Further, since the shields of the cables are effectively grounded by the connector covers, etc., the number of contact pins and patterns for the PC board can be reduced, as there is no need to provide specific contact pins for grounding.

Also static electricity is not generated, since the connector cover, the latch lever and the guides form a shield circuit which is integrally grounded.

Figure 7:
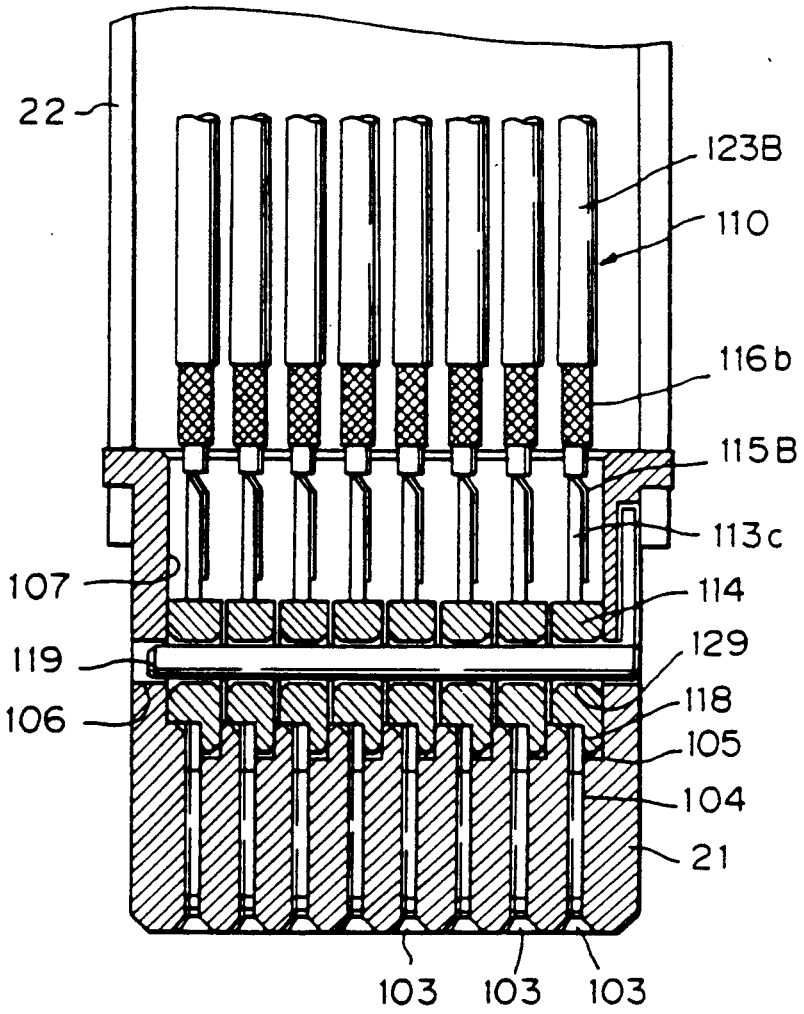
FIG. 7 is a partially sectional side elevational view of a connector according to the present invention.
Figure 8:
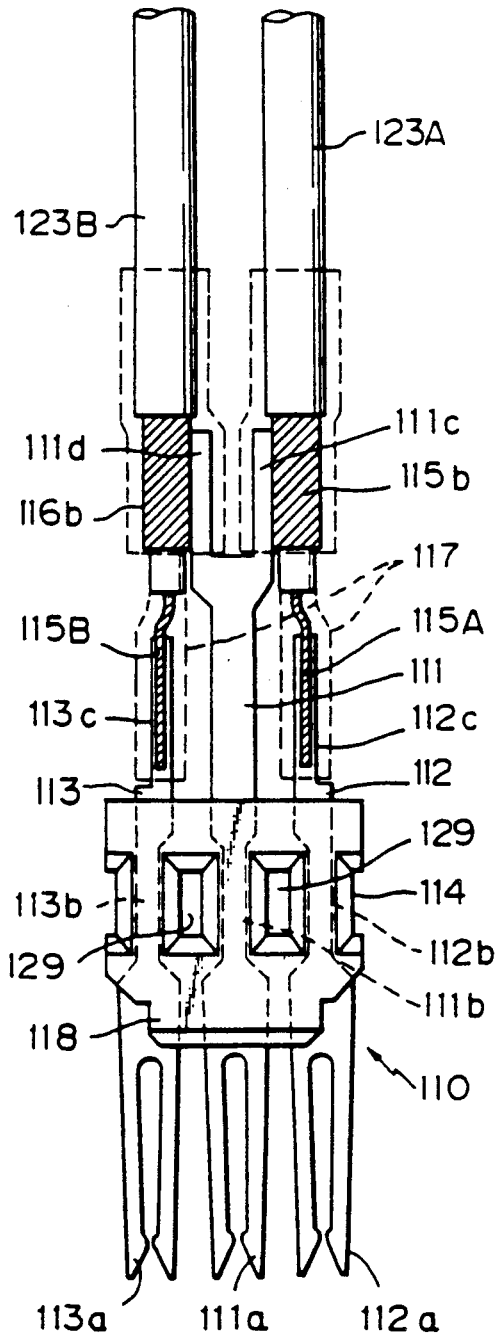
FIGS. 8 and 9 are front and side elevational views of a contact assembly shown in FIG. 7, respectively.
Figure 9:
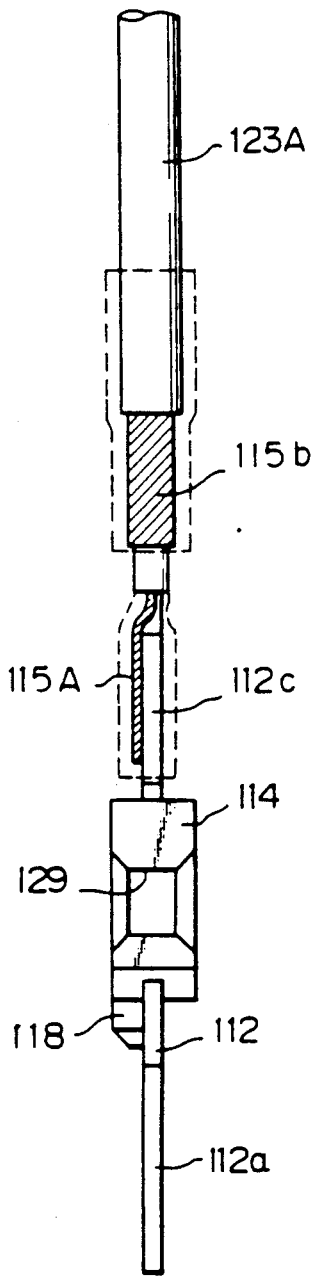

FIGS. 7 to 9 show the internal construction of the connector body 21.

In the connectors for the coaxial cable assembly 23 according to the prior art, each of the coaxial cables (123A, 123B, etc.) in the cable assembly 23 has at least one signal line and a grounded shield. Accordingly, when the number of the coaxial cables in one cable assembly is increased, the number of corresponding contacts of the connector body to be connected to the signal lines and the grounded shield must be increased. Furthermore, in the prior art, the coaxial cables in the cable assembly are separate from each other, and accordingly, the assembly thereof is cumbersome.

To solve these problems, according to another aspect of the present invention, two coaxial cables are paired and have a common ground, to reduce the number of the contacts in the connector body, and thus make it possible to reduce the space (pitch) between the contacts.

Namely, in any one pair of coaxial cables, one contact for grounding is provided commonly to the two coaxial cables of the pair Preferably the contacts for the signal lines are located on opposite sides to the grounding contact.

As shown in FIGS. 7, 8 and 9, the bottom part of the connector body 21, the upper part of which is covered by the cover 22 as mentioned before, is provided with a plurality of pin insertion holes 103, arranged in three rows in the illustrated embodiment, and a contact assembly 110 is located above each pin insertion hole 103.

The contact assembly 110 will be described below in detail with reference to FIGS. 8 and 9.

Each contact assembly 110 is provided with a center elongated connecting piece 111 for grounding (referred to hereinafter as a ground connecting piece) and right and left short connecting pieces 112 and 113 for signal lines (referred to hereinafter as signal connecting pieces). The signal connecting pieces 112 and 113 are located on opposite sides of and in parallel with the center ground connecting piece 111, with a space therebetween. The pieces 111, 112, and 113 are provided at intermediate portions thereof with recessed portions 111*b*, 112*b* and 113*b*, and are made integral with each other at the recessed portions 111*b*, 112*b* and 113*b* by a holder 114, preferably made of plastic.

The lower ends of the pieces 111, 112, and 113 are provided with forked or bifurcated contacts 111*a*, 112*a*, and 113*a* lying in a plane, i.e. in a row, and two coaxial cables (e.g., 123A and 123B) are located above and substantially in line with the signal connecting pieces 112 and 113.

The signal lines 115A and 115B of the cables 123A and 123B are fixed to upper ends 112*c* and 113*c* of the connecting pieces 112 and 113 by heat-shrinkable tubings 117. The upper end of the ground connecting piece 111 extends upward beyond the upper ends 112*c* and 113*c* of the signal connecting pieces 111 and 112 and is bifurcated to form terminal ends 111*c* and 111*d* which are soldered directly to the shields 115*b* and 116*b* of the cables 123A and 123B. The holder 114 is provided with clamp pin holes 129 located between the recessed portions 111*b* and 112*b* and between the recessed portions 112*b* and 113*b* thereof. Note, the holder 114 is also provided with a projection 118 on one side face thereof, to enable the operator to differentiate the front and rear sides of the holder 114.

The connector body 21 is provided as shown in FIG. 7 with contact holes 104 directly above the pin inserting holes 103, stepped portions 105 for accommodating the projections 118 of the holders 114, pin holes 106, and a chamber 107 for receiving the contact assembly 110. When the contact assembly 110 is inserted in the receiving chamber 107, the projections 118 of the holders 114 are engaged in the stepped portions 105, and the contacts 111*a*, 112*a*, and 113*a* are inserted in the associated contact holes 104. The other contact assemblies 110 are similarly inserted in the connector body 21 in a side by side arrangement, so that the holders 114 are brought into contact with each other at the longitudinal opposite sides thereof. Thus, when all of the contact assemblies 110 have been inserted in the connector body 21, clamp pins 119 are inserted in the pin holes 129 through the pin holes 106 to prevent an accidental removal of the contact assemblies 110 from the connector body 21.

In this arrangement, when the connector body 21 is fitted onto contact pins provided on the mother board 1, the contact pins of the mother board 1 are inserted in the associated pin insertion holes 103 and the associated contacts 111*a*, 112*a*, and 113*a* and connected thereto in a plug-in manner.

In the arrangement shown in FIGS. 7 to 9, two coaxial cables 123A and 123B are paired and provided with a common ground, and accordingly, theoretically the number of ground contacts can be cut by half, and thus a small and compact connector mechanism having a reduced pitch of the contacts can be obtained.

Note, the arrangement of the signal lines on opposite sides of the ground line contributes to a reduction of noise, and since the cables are soldered to the corresponding signal connecting pieces substantially in a straight line, damage to the cables can be reduced.

Figure 10:
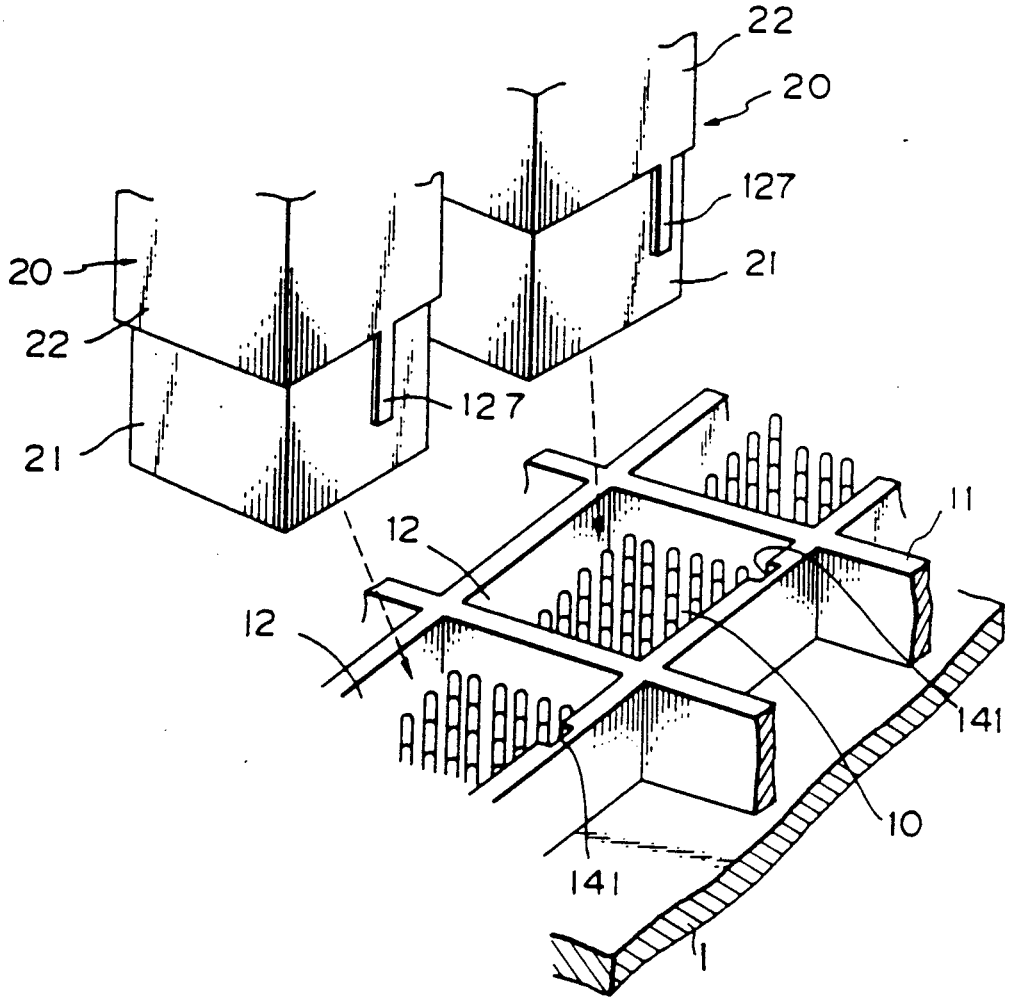
FIG. 10 is a perspective view of a connector apparatus having an individualizing means, according to the present invention.
Figure 11:
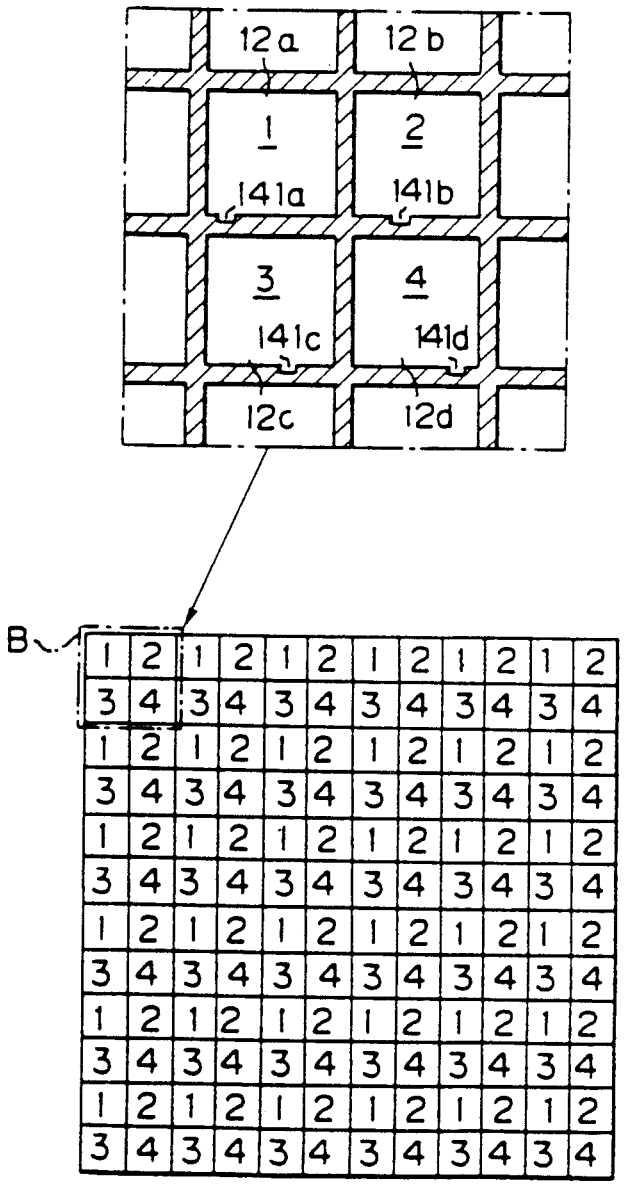
FIG. 11 is a schematic view of a matrix arrangement of connecting portions defined by guides, according to the present invention.

FIGS. 10 and 11 show an embodiment directed to a prevention of a faulty connection between the connectors and the contact pins on the mother board 1 (PC board 2), according to another aspect of the present invention.

Figure 12:
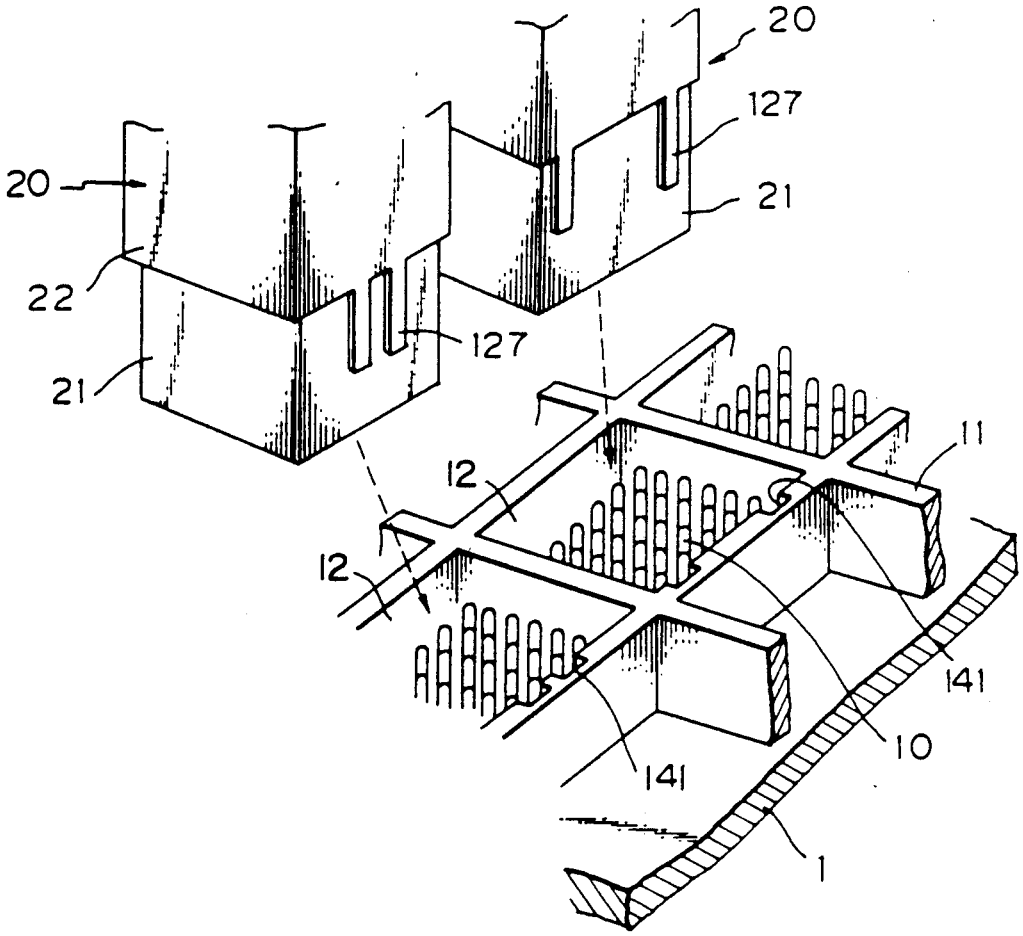
FIG. 12 is a perspective view similar to FIG. 11, but showing another embodiment of the individualizing means.
Figure 14:
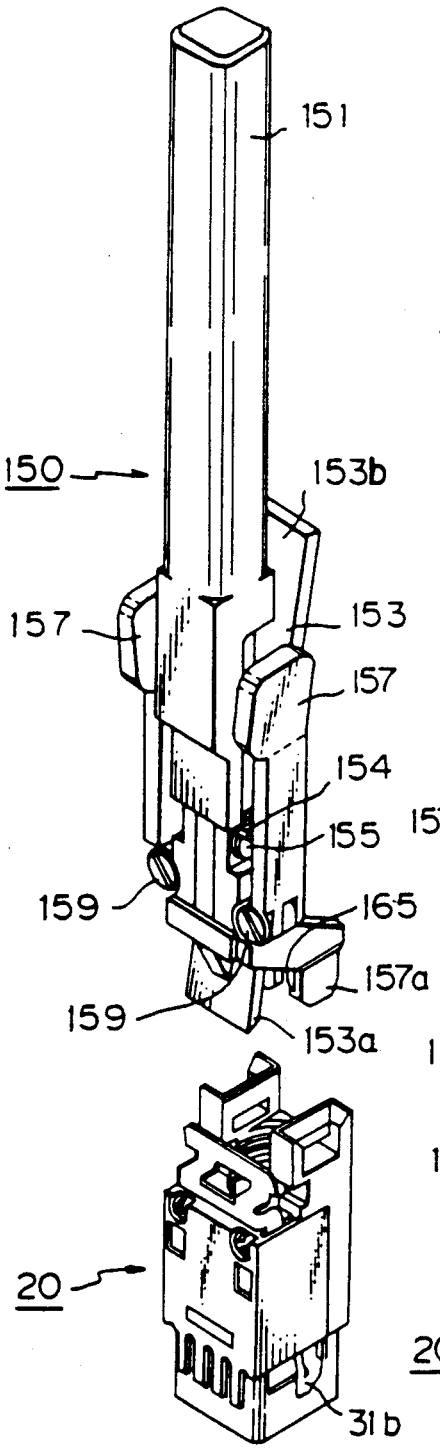
FIG. 14 is a perspective view of the jig shown in FIG. 13, in which the jig is disconnected from a connector.

As shown in FIGS. 10 and 11, the connector cover 22 of the connector 20 is provided with downwardly extending tongues 127 which serve as a bar code, as often used, for example, in a POS (Point Of Sales) system. Namely, each connector cover 22 is provided on one side thereof with a tongue or tongues 127, as can be seen from FIG. 10. The positions of the tongues of adjacent connectors 20 are different from each other, to provide each connector 20 with an individual identity. Namely, as can be seen in FIG. 10, the tongues 127 of the adjacent connectors 20 are located in different positions. Alternatively, as shown in FIG. 12 a plurality of tongues 127 can be provided on each connector 20, and these tongues 127 will function as a bar code as used in a POS system.

The guides 11 are provided with recesses 141 on the side walls thereof corresponding to the tongues 127 of the associated connectors 20, as shown in FIG. 10. Consequently, only connectors 20 having tongues 127 corresponding to the recesses 141 of the guides 11 can be inserted in the associated guides 11. Namely, if a connector 20 is inserted in an incorrect guide 11, the tongue or tongues 127 will not fit in the recess or recesses 141 of the incorrect guide 11. Further, since the tongue 127 is provided on only one side of the cover 22 of the connector 20, the direction (right side, left side, front side or rear side) of the connector cover 22 can be easily and visually determined by the engagement of the tongues 127 and the recesses 141.

Alternatively, the tongues (male members) 127 and the recesses (female members) can be provided on a side wall of the guides 11 and one side face of the connector cover 22, respectively.

Further, the tongues 127 can be of different widths, to provide individuality to the connectors 20.

Furthermore, the tongues 127 can be provided on two or more adjacent or opposite side faces of the connector covers 22 or the side walls of the guides 11.

In particular, when one tongue is provided on one connector cover (or on one guide wall), preferably identical connectors having a plurality of tongues 127, the number of which corresponds to the number of kinds of tongues, are manufactured so that, when the connection of the connectors to the contact pins provided on the mother board 1 (i.e., the PC board) is to be made in accordance with a specific design, only one tongue is kept and the other tongues are removed. This provides an increased mass-productivity and an easier maintenance of such identical connectors.

FIG. 11 shows a practical matrix arrangement of the connectors, as an example.

The four connecting portions 12 (12*a*, 12*b*, 12*c*, and 12*d*) of the mother board 1 form one block B, and a number of blocks B are arranged in a matrix on the mother board 1. As seen in the block B shown in FIG. 11, the guides 11*a*, 11*b*, 11*c*, and 11*d* of the four connecting portions are provided with the recesses 141*a*, 141*b*, 141*c*, and 141*d* at different positions, and the four associated connectors 20 (not shown in FIG. 11) are provided with the tongues 127 at positions corresponding to the associated recesses 141*a*, 141*b*, 141*c*, and 141*d*. The combinations of numerals 1 to 4 in the matrix arrangement in FIG. 11 are different at each block B.

As can be seen from the above description, according to the present invention, since the connectors can be given addresses and orientations (directions) by the male (tongue) and female (recess) address allocating means, a faulty connection or incorrect polarity will not occur.

FIGS. 13 to 16 show a special jig 150 for mounting and dismounting the connector to and from the contact pins on the mother board 1 (or the PC board). This jig is particularly useful when the connectors are mounted in a high density matrix arrangement.

Figure 16:
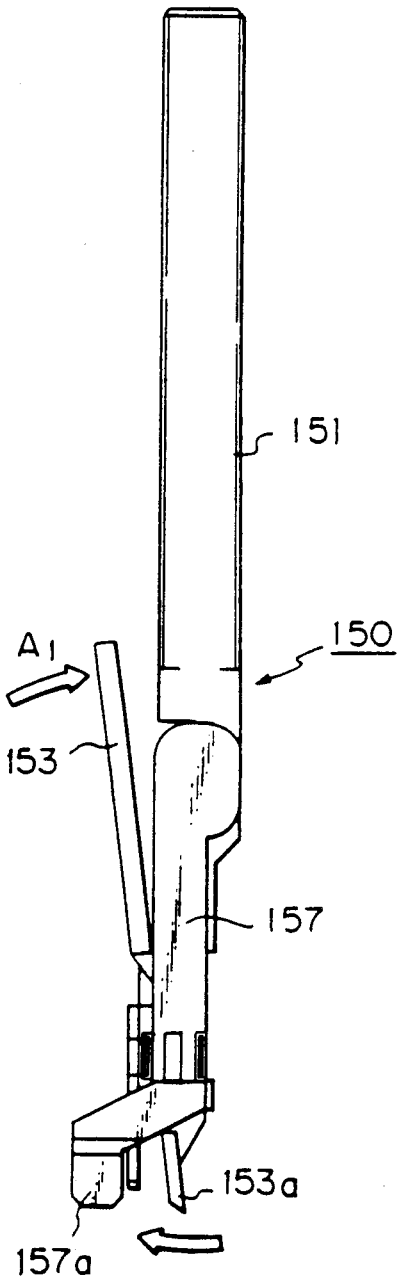

The jig 150 is provided with a shank 151 to serve as a grip for the operator, and a connector unlocking lever 153 rotatably supported by the lower end of the shank 151 at a point close to the connector 20, through a pivot pin 155 extending perpendicular to the length of the shank 151. The connector unlocking lever 153 rotates in the clockwise direction $A_1$ in FIG. 16. After the jig 150 is attached to the associated connector 20, as described hereinafter, the upper end thereof is manually pushed close to the shank 151 and the connector unlocking lever 153 is rotated in the clockwise direction $A_1$ in FIG. 16, so that the lower end 153*a* of the lever 153 is pressed against the grip 31*e* (FIGS. 4A, 4B, and 5) of the latching lever 31 to exert pressure on the grip 31*e* to unlock the hooks 31*b* of the latching lever 31 from the associated abutments 33 of the guide 11 (FIG. 6). Note, the hooks 31*b* can be manually disengaged or unlocked from the associated abutments 33 without using the jig 150, i.e., the grip 31*e* can be directly moved by the operator's finger to unlock the hooks 31*b* from the associated abutments 33. The lever 153 is continuously biased in an open position by a spring 154 provided around the pivot pin 155, in which the lower end 153*a* of the lever 153 is held apart from the associated lower ends 157*a* of the clamping levers 157, as can be seen in FIG. 16.

The jig 150 is also provided with a pair of clamping levers 157 rotatably supported at the lower end of the shank 150 by respective pivot pins 159 extending perpendicular to the pivot pin 155 and to the length of the shank 151. The clamping levers 157 are continuously biased to a closed position by springs 161 provided between the shank 151 and the levers 157, in which the lower ends of the levers 157 adjacent to the connector 20 are brought close to each other. The clamping levers 157 are opened in the directions $A_2$ (FIG. 15) at the lower end thereof, against the force of the springs 161, by pressing the upper ends of the clamping levers 157 toward each other in the directions $A_3$ in FIG. 15.

Figure 13:
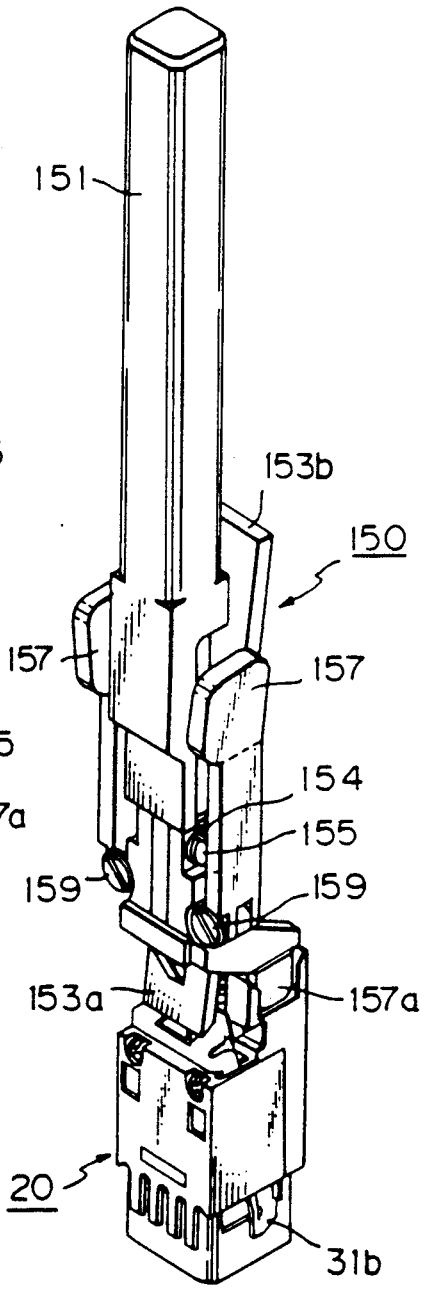
FIG. 13 is a perspective view of a jig which can be used to mount and dismount a connector to and from a substrate.
Figure 15:
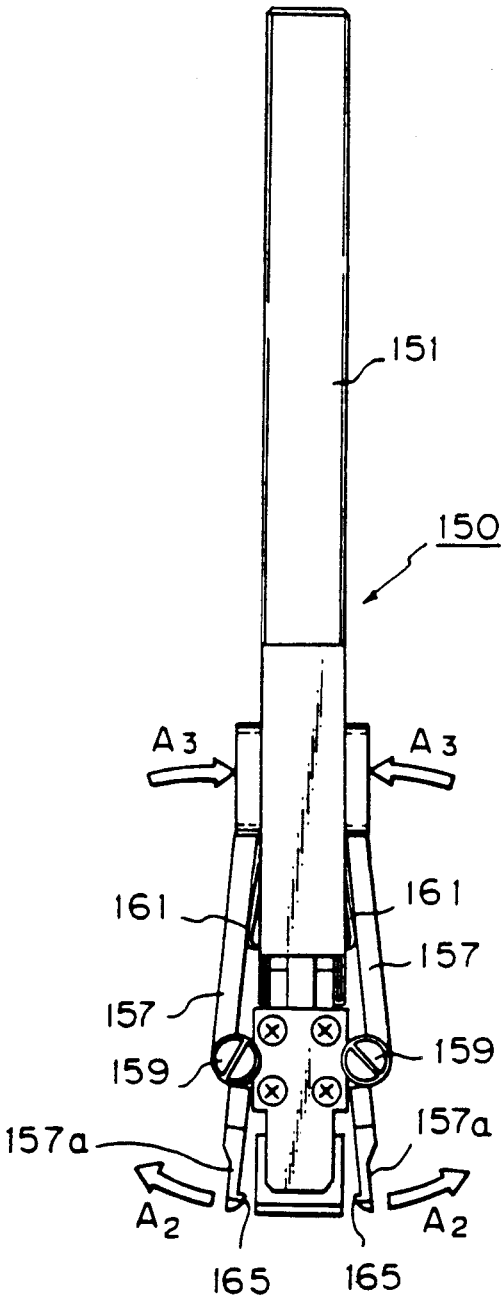
FIG. 15 is a side elevational view showing how to operate clamping levers of the jig; and, FIG. 16 is a side elevational view of FIG. 15 showing how to operate an unlocking lever of the jig.

The lower ends 157*a* of the clamping levers 157 are provided with claws 165 which can be engaged in corresponding clamping recesses or openings 167 (FIG. 3) formed in opposite sides of the cable mounting portion 22*a* of the cable cover 22, when the clamping levers 157 are in the closed position. When the clamping levers 157 are brought to the open position in which the lower ends 157*a* of the levers 157 are separated from each other, the claws 165 of the clamping levers 157 are engaged in the associated clamping openings 167. When the external force applied to the upper ends of the clamping levers 157 in the direction $A_3$ is released, the clamping levers 157 are automatically returned to the closed position, so that the claws 165 are engaged in the corresponding opposed clamping openings 167 from the opposite sides of the connector 20, and as a result, the connector 20 is firmly held by the jig 150, as shown in FIG. 13. Since the jig 150 substantially has no part projecting outward from the width of the connector, the jig can be easily and firmly connected to the associated connector without interfering with an adjacent connector.

When the connector 20 is to be disconnected from the mother board 1, the jig 150 is first attached to the connector 20 by engaging the claws 165 in the corresponding clamping openings 167 of the connector, and then the unlocking lever 153 is pressed toward the shank 151 of the jig 150 at the upper end 153*b* of the lever 153 to disengage the hocks 31*b* from the associated abutments 33 of the guide 11 of the mother board 1, as mentioned before, and as a result, the connector 20 is unlocked from the mother board (guide 11). Then, the jig 150 is pulled up with a force sufficient to overcome the contact pressure between the contacts (111*a*, 112*a*, etc., in FIG. 8) of the connector 20 and the contact pins 10 (FIG. 10) on the mother board 1, to separate the connector 20 from the mother board 1.

When the connector 20 is completely disconnected from the mother board, the clamping levers 157 are opened to disengage the claws 165 from the corresponding openings 167 of the connector, and the jig 150 is removed from the connector 20.

As shown above, when the connector 20 is mounted to the mother board 1 with the help of the jig 150, the jig is first attached to the connector and then the connector is inserted onto the mother board 1. When the connector is inserted, however, it is not necessary for the operator to operate the unlocking lever 153, since the hooks 31*b* can be automatically displaced to be engaged in the associated abutments 33 by the tapered upper faces 33*a* of the abutments 33. Namely, the hooks 31*b* slide over the tapered upper faces 33*a* of the abutments 33, while elastically deforming, when the connector is forced into the associated guide 11 of the mother board 1, as mentioned before.

What is claimed is:

1. An apparatus for connecting a high density cable assembly to be connected to corresponding contact pins provided no a substrate having guides, each guide having a predetermined number on contact pins therein, the apparatus comprising: a connector to which the cable assembly is connected and which is to be mounted on the associated guide, said connector having a connector body guided by the associated guides and a connector cover surrounding the connector body, and latching means, rotatably mounted between the connector body and the connector cover, for latching the connector to the associated guides, and wherein electrical shielding of the cable assembly is effected by the guides and connector cover.

2. A connector apparatus according to claim 1, wherein said guides have abutments on the side walls thereof, and wherein said latching means comprises a latching lever having hooks which engage with the abutments.

3. A connector apparatus according to claim 2, wherein an upper end of said latching lever is provided with a grip which can be manually pressed to bring the latching lever into a unlocked position in which the hooks are disengaged in the corresponding abutments of the guides.

4. A connector apparatus according to claim 3, wherein said latching lever has two legs located on opposite sides of the connector body and between the connector body and the connector cover.

5. A connector apparatus according to claim 4, wherein said cable assembly comprises a plurality of coaxial cables each having a shield and signal lines.

6. A connector apparatus according to claim 5, wherein two of said coaxial cables are paired.

7. A connector apparatus according to claim 6, wherein said connector comprises one contact assembly for each pair of coaxial cables.

8. A connector apparatus according to claim 7, wherein each of said contact assemblies comprises a ground connecting piece commonly connected to the shields of the associated pair of coaxial cables and two signal connecting pieces connected to the signal lines of the associated pair of coaxial cables.

9. A connector apparatus according to claim 8, wherein each of said contact assemblies comprises a holder which joins the ground connecting piece and the signal connecting pieces of the associated pair of coaxial cables.

10. A connector apparatus according to claim 9, wherein the lower ends of each of said ground connecting piece and said signal connecting pieces are formed as bifurcated contacts.

11. A connector apparatus according to claim 8, wherein said signal connecting pieces in each pair of coaxial cables are located on opposite sides of the ground connecting piece.

12. A connector apparatus according to claim 8, wherein said abutments have tapered abutting surfaces over which the hooks of the latching lever can slide when the hooks are pressed thereon.

* * * * *

UNITED STATES PATENT AND TRADEMARK OFFICE

CERTIFICATE OF CORRECTION

PATENT NO. : 4,998,884

DATED : March 12, 1991

INVENTOR(S) : Kouji ISHIKAWA, et al.

It is certified that error appears in the above-identified patent and that said Letters Patent is hereby corrected as shown below:

Col. 1, line 15, "PC board" should be --"PC board"--;

line 37, "complex there" should be --complex. There--;

line 38, "fore and therefore," should be --fore,--;

Col. 2, line 34, "1" should be --1,--;

Col. 6, line 38, after "provided" insert --,--;

line 39, after "7" insert --,--; and

Col. 9, line 46, "no" should be --on--.

Signed and Sealed this

Twenty-eighth Day of July, 1992

*Attest:*

DOUGLAS B. COMER

*Attesting Officer*

*Acting Commissioner of Patents and Trademarks*